US009790945B2

(12) United States Patent
Tiedtke et al.

(10) Patent No.: US 9,790,945 B2
(45) Date of Patent: Oct. 17, 2017

(54) RADIAL COMPRESSOR AND COMPRESSOR ARRANGEMENT WITH SUCH A RADIAL COMPRESSOR

(71) Applicants: Alf-Peter Tiedtke, Muelheim an der Ruhr (DE); Andre Hildebrandt, Oberhausen (DE); Thomas Ceyrowsky, Duisburg (DE); Hauke Strohmeyer, Essen (DE)

(72) Inventors: Alf-Peter Tiedtke, Muelheim an der Ruhr (DE); Andre Hildebrandt, Oberhausen (DE); Thomas Ceyrowsky, Duisburg (DE); Hauke Strohmeyer, Essen (DE)

(73) Assignee: MAN Diesel & Turbo SE, Augsburg (DE)

( * ) Notice: Subject to any disclaimer, the term of this patent is extended or adjusted under 35 U.S.C. 154(b) by 307 days.

(21) Appl. No.: 14/573,916

(22) Filed: Dec. 17, 2014

(65) Prior Publication Data

US 2015/0167675 A1 Jun. 18, 2015

(30) Foreign Application Priority Data

Dec. 18, 2013 (DE) ..... 10 2013 022 146

(51) Int. Cl.

| | |
|---|---|
| ***F04D 17/10*** | (2006.01) |
| ***F04D 25/16*** | (2006.01) |
| ***F04D 29/44*** | (2006.01) |
| ***F04D 17/02*** | (2006.01) |
| ***F04D 29/42*** | (2006.01) |

(52) U.S. Cl.

CPC ..... *F04D 17/10* (2013.01); *F04D 17/025* (2013.01); *F04D 25/16* (2013.01); *F04D 29/4213* (2013.01); *F04D 29/44* (2013.01); *F04D 29/444* (2013.01); *F05D 2250/51* (2013.01)

(58) Field of Classification Search

CPC ..... F04D 17/025; F04D 17/10; F04D 25/16; F04D 29/4213; F04D 29/44; F04D 29/444; F05D 2250/51

See application file for complete search history.

(56) References Cited

U.S. PATENT DOCUMENTS 2,350,839 A * 6/1944 Szydlowski ..... F04D 21/00 415/143
2,570,081 A * 10/1951 Szczeniowski ..... A01M 29/18 116/137 A
2,609,141 A * 9/1952 Aue ..... F04D 17/165 415/208.2
3,447,740 A * 6/1969 Friberg ..... F04D 19/02 415/144

(Continued)

FOREIGN PATENT DOCUMENTS

DE 10 2009 016 392 A1 10/2010

*Primary Examiner* — Igor Kershteyn
(74) *Attorney, Agent, or Firm* — Cozen O'Connor

(57) ABSTRACT

A radial compressor for a compressor arrangement comprising the radial compressor and an axial compressor includes an inlet flow channel bounded by a radially inner hub contour and a radially outer housing contour, in which inlet guide blades are arranged. Via the inlet flow channel a medium to be compressed is supplied to an impeller having moving blades. The inlet flow channel runs diagonally to an axis of rotation of the impeller.

17 Claims, 1 Drawing Sheet

(56) References Cited

U.S. PATENT DOCUMENTS

| | | | | |
|---|---|---|---|---|
| 4,428,715 | A * | 1/1984 | Wiggins | F04D 17/127<br>415/199.2 |
| 8,231,341 | B2 * | 7/2012 | Anderson | F02C 3/08<br>415/181 |
| 2012/0189431 | A1 | 7/2012 | Gingter et al. | |

* cited by examiner

RADIAL COMPRESSOR AND COMPRESSOR ARRANGEMENT WITH SUCH A RADIAL COMPRESSOR

BACKGROUND OF THE INVENTION

1. Field of the Invention

The invention relates to a radial compressor and a compressor arrangement with such a radial compressor.

2. Description of the Related Art

From DE 10 2009 016 392 A1 a compressor arrangement with an axial compressor and a radial compressor is known, which are arranged axially one behind the other on a common shaft. According to DE 10 2009 016 392 A1, assemblies on the rotor side of the or each axial compressor stage of the axial compressor and assemblies on the rotor side of the or each radial compressor stage of the radial compressor are arranged on the common driveshaft or fastened to the same.

According to DE 10 2009 016 392 A1, a medium that is compressed in the region of the axial compressor is supplied, following the compression in the axial compressor to the radial compressor for further compression, wherein the medium to be compressed is supplied to the radial compress via an inlet flow channel and can be conducted via the inlet flow channel in the direction of an impeller positioned downstream of the inlet flow channel. In the region of the inlet flow channel, inlet guide blades are arranged, wherein the inlet flow channel according to DE 10 2009 016 392 A1 exclusively extends in the radial direction to the axis of rotation of the impeller. Medium flowing through the inlet flow channel accordingly flows through the channel in the radial direction, perpendicularly to the axis of rotation of the impeller of the radial compressor.

SUMMARY OF THE INVENTION

Starting out from this, an object of the present invention is to create a new type of radial compressor and a compressor arrangement with such a radial compressor.

This object is achieved through a radial compressor in which the inlet flow channel runs diagonally to an axis of rotation of the impeller.

According to an aspect of the invention, the inlet flow channel of the radial compressor according to the invention runs diagonally to the axis of rotation of the impeller, so that accordingly a flow direction of the medium flowing through the inlet flow channel runs diagonally to the axis of rotation of the impeller. Because of this it is possible to provide a radial compressor with a short axial length. Through the shortened length of the flow path in the region of the inlet flow channel, the aero-thermodynamic characteristic of the radial compressor can be improved. Accordingly, with a minimization of the pressure loss in the inlet flow channel, a higher uniformity of the inflow to the impeller is ensured at the same time.

Preferentially, the radial inner hub contour of the inlet flow channel is continuously curved between a start of the same and an end of the same, whereas a radially outer housing contour of the inlet flow channel, adjacent to a start of the same, comprises a linearly running section and adjacent to an end of the same, a curved section. Radially outer ends of flow inlet edges and radially outer ends of flow outlet edges of the inlet guide blades each preferentially merge into the linearly running section of the radially outer housing contour.

Through the above contouring of the radially inner contour and the radially outer housing contour a particularly advantageous flow configuration in the region of the inlet flow channel of the radial compressor subject to minimizing the axial length of the same can be ensured. In particular when the flow inlet edges and the flow outlet edges of the inlet guide blades merge into the linearly running section of the radially outer housing contour can the aero-thermodynamic characteristic of the radial compressor be further improved.

According to an advantageous further development of the invention, the linearly running section of the radially outer housing contour includes an angle between 42.75° and 71.25° with the axis of rotation of the impeller. A stacking axis of the inlet guide blades includes an angle between 33.75° and 56.25° with the axis of rotation of the impeller.

Through these two angles, which are used on a radial compressor either atone or preferably combined with one another, the aero-thermodynamic characteristic of the same can be further improved.

According to an advantageous further development of the invention, the following relationships apply in the region of the radially inner hub contour:

$$0.383<h1/h3<0.638,$$

$$0.518<h2/h3<0.863,$$

wherein h1 is the arc length of the radially inner hub contour between the start of the same and the end of the flow inlet edges of the inlet guide blades merging into the same, wherein h2 is the arc length of the radially inner hub contour between the start of the same and the end of the flow outlet edges of the inlet guide blades merging into the same, whereas h3 is the arc length of the radially inner hub contour between the start of the same and the end of the same, wherein h1/h3<h2/h3.

These relationships in the region of the radially inner hub contour ensure a further improvement of the aero-thermodynamic characteristics of the radial compressor.

According to an advantageous further development of the invention, the following relationships apply in the region of the radially outer housing contour:

$$0.285<s1/(s3+s4)<0.475,$$

$$0.555<s2/(s3+s4)<0.925,$$

$$2.52<s3/s4<4.20.$$

wherein s1 is the edge length of the radially outer housing contour between the start of the same and the end of the flow inlet edges of the inlet guide blades merging into the same, wherein s2 is the edge length of the radially outer housing contour between the start of the same and the end of the flow outlet edges of the inlet guide blades merging into the same, wherein s3 is the edge length of the linearly running section of the radially outer housing contour, wherein s4 is the arc length of the section running curved of the radially outer housing contour, and wherein s1/(s3+s4)<s2/(s3+s4).

These relationships in the region of the radially outer housing contour ensure further improvement of the aero-thermodynamic characteristic of the radial compressor.

Preferred further developments of the invention are obtained from the following description.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Exemplary embodiments of the invention are explained in more detail with the help of the drawings without being restricted to this. In the drawings.

DETAILED DESCRIPTION OF THE PRESENTLY PREFERRED EMBODIMENTS

The present invention relates to a radial compressor and to a compressor arrangement with such a radial compressor. In particular, the invention relates to a compressor arrangement with a radial compressor and an axial compressor, wherein radial compressor and axial compressor are combined with one another in a so-called back-to-back compressor arrangement. Although the use of the radial compressor according to the invention in such a compressor arrangement of a radial compressor and an axial compressor, which form a back-to-back compressor arrangement, is preferred, the invention is not restricted to this application case of the radial compressor according to the invention.

Figure 1:
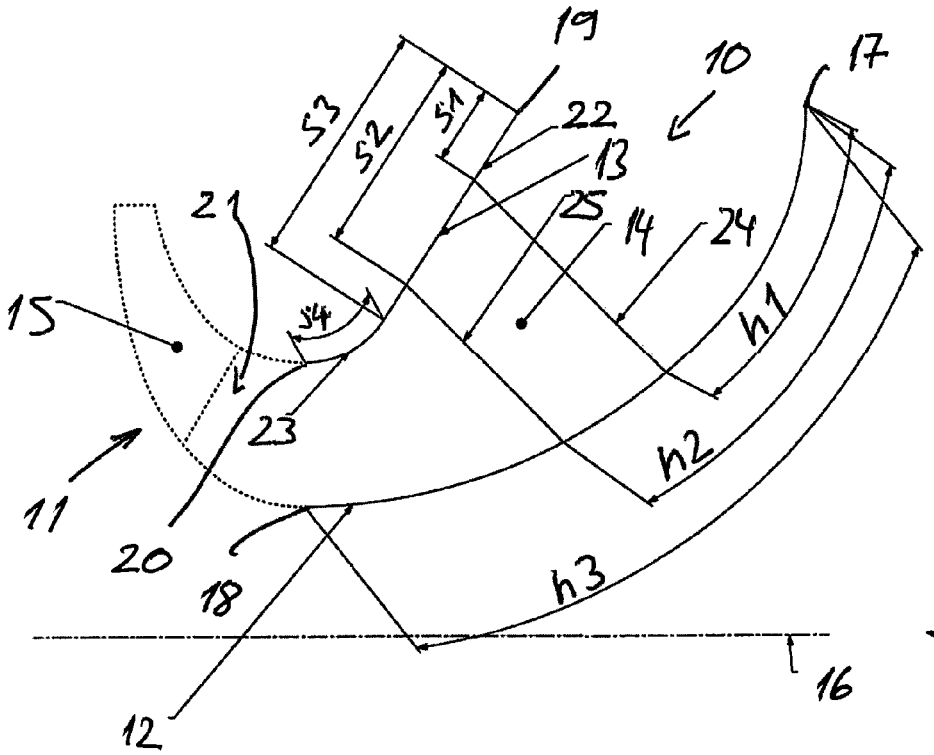
FIG. 1: is a detail of a radial compressor according to the invention in meridional section for illustrating design parameters of the radial compressor.
Figure 2:
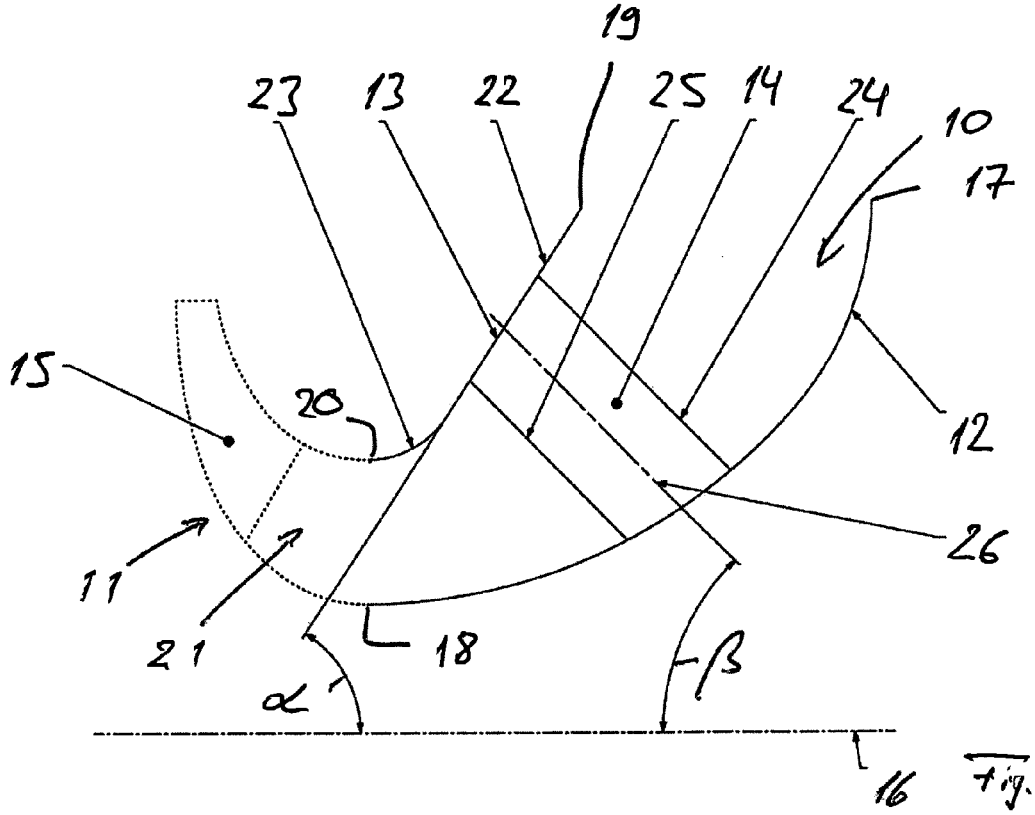
FIG. 2 shows the detail of FIG. 1 for illustrating further design parameters of the radial compressor.

Medium to be compressed in the radial compressor according to the invention can be supplied to an impeller 11 via an inlet flow channel 10, wherein the medium to be compressed can be conducted via the inlet flow channel 10 in the direction of the impeller 11 of the radial compressor. FIGS. 1 and 2 show a meridional section through a detail of a radial compressor according to the invention in the region of the inlet flow channel 10 and of the impeller 11 arranged downstream of the inlet flow channel 11, wherein according to FIGS. 1 and 2 in the inlet flow channel 10. which is bounded by a radially inner hub contour 12 and a radially outer housing contour 13, inlet guide blades 14 are arranged. The impeller 11, which is arranged downstream of the inlet flow channel 10, comprises moving blades 15.

In terms of the present invention, the inlet flow channel 10 runs diagonally to an axis of rotation 16 of the impeller 11, that is diagonally to rotating shafts of the radial compressor, so that medium to be compressed in the radial compressor accordingly flows through the inlet flow channel 10 diagonally to the axis of rotation 16 of the impeller 11 of the radial compressor.

As already explained above, the inlet flow channel 10 is bounded by a radially inner hub contour 12 and a radially outer housing contour 13, wherein in FIGS. 1 and 2 a start of the radially inner hub contour 12 is marked with the reference number 17 and an end of the radially inner hub contour 12 with the reference number 18, and wherein a start of the radially outer housing contour 13 is marked with the reference number 19 and an end of the outer housing contour 13 with the reference number 20. At the ends 18 and 20 of the hub contour 12 and of the housing contour 13, which preferentially lie in an identical axial position but are spaced from one another in the radial direction, the inlet flow channel 10 merges into a suction mouth region 21 of the impeller 11. At the start 17, 19 of hub contour 12 and housing contour 13, which in FIGS. 1 and 2 lie in the identical radial position but are spaced from one another in axial direction, the inlet flow channel 10 merges into a suction connector of the radial compressor.

According to an advantageous further development of the invention, the radially inner hub contour 12 is continuously curved between the start 17 and the end 18 of the same, namely convexly towards the outside without a change in curvature.

The radially outer housing contour 13 of the inlet flow channel 10 has a linearly running section 22 adjacent to the start 19 of the same and a curved section 23 adjacent to the end 20 of the same.

At the transition of the medium to be compressed from the suction connector of the radial compressor, which is not shown to the inlet flow channel 10, the medium adjacent to the radially outer housing contour 13 accordingly is initially conducted linearly and adjacent to the radially inner hub contour 12, in a curved manner. Further downstream, adjacent to the end of the inlet flow channel 10, the medium to be compressed is conducted in a curved manner both adjacent to the radially outer housing contour 13 and also adjacent to the radially inner hub contour 12 in each case.

The inlet guide blades 14, which are positioned in the inlet flow channel 10, have a flow inlet edge 24 and a flow outlet edge 25. The flow outlet edge 25 is always positioned downstream of the flow inlet edge 24. According to an advantageous further development of the invention it is provided that the radially outer ends of the flow inlet edges 24 and of the flow outlet edges 25 of the inlet guide blades 14 each merge into the linearly running section 22 of the radially outer housing contour 13.

In the preferred exemplary embodiment shown in FIGS. 1 and 2, the flow inlet edges 24 and the flow outlet edges 25 of the inlet guide blades 14 form, in each instance, an angle other than 90° with the linearly running section 22 of the radially outer housing contour 13, so that the flow inlet edges 24 and the flow outlet edges 25 accordingly do not extend perpendicularly to the linearly running section 22 of the radially outer housing contour 13. Furthermore, it is provided in the preferred exemplary embodiment of FIGS. 1 and 2 that neither the flow inlet edges 24 nor the flow outlet edges 25 of the inlet guide blades 14 on the one hand run perpendicularly and on the other hand parallel with respect to the axis of rotation 16 of the impeller 11.

The linearly running section 22 of the radially outer housing contour 13 includes an angle $\alpha$ with the axis of rotation 16 of the impeller 11 which preferably is between 42.75° and 71.25°.

Preferably, the angle $\alpha$ is between 48.45° and 65.55°. Particularly preferably, the angle $\alpha$ is between 54.15° and 59.85°.

A stacking axis 26 of the inlet guide blade 14 includes an angle $\beta$ with the axis of rotation 16 of the impeller 11, which preferentially is between 33.75° and 56.25°.

Preferably, the angle $\beta$ is between 38.25° and 51.75°. Particularly preferably, the angle $\beta$ is between 42.75° and 47.25°.

In the region of the radially inner hub contour 12, the following relationships apply:

$$0.383<h1/h3<0.638,$$

$$0.518<h2/h3<0.863,$$

wherein h1 is the arc length of the radially inner hub contour 12 between the start 17 of the same and the end of the flow inlet edges 24 of the inlet guide blades 14 merging into these, wherein h1 is the arc length of the radially inner hub contour 12 between the start 17 of the same and the end of the flow outlet edges 25 of the inlet guide blades 14 merging into the same, wherein h3 is the arc length of the radially inner hub contour 12 between the start 17 of the same and the end 18 of the same, wherein h1/h3<h2/h3. Preferably, the following relationships apply in the region of the radially inner hub contour 12:

$$0.434<h1/h3<0.587,$$

$$0.587<h2/h3<0.794.$$

Particularly preferably, the following relationships apply in the region of the radially inner hub contour 12:

$$0.485<h1/h3<0.536,$$

$$0.656<h2/h3<0.725.$$

In the region of the radially outer housing contour 13, the following relationships apply:

$$0.285<s1/(s3+s4)<0.475,$$

$$0.555<s2/(s3+s4)<0.925,$$

$$2.52<s3/s4<4.2,$$

wherein s1 is the edge length of the radially outer housing contour 13 between the start 19 of the same and the end of the flow inlet edges 24 of the inlet guide blades 14 merging into the same, wherein s2 is the edge length of the radially outer housing contour 13 between the start 19 of the same and the end of the flow outlet edges 25 of the inlet guide blades 14 merging into the same, wherein s3 is the edge length of the linearly running section 22 of the radially outer housing contour 13, wherein s4 is the edge length of the curved running section 23 of the radially outer housing contour 13, and wherein s1/(s3+s4)<s2/(s3+s4).

Preferably, the following relationships apply in the region of the radially outer housing contour 13:

$$0.323<s1/(s3+s4)<0.437,$$

$$0.629<s2/(s3+s4)<0.851,$$

$$2.856<s3/s4<3.864.$$

Particularly preferably, the following relationships apply in the region of the radially outer housing contour 13:

$$0.361<s1/(s3+s4)<0.399,$$

$$0.703<s2/(s3+s4)<0.777,$$

$$3.192<s3/s4<3.528.$$

The above read-out parameters with respect to the angles α and β and with respect to the relationships in the region of the radially inner hub contour 12 and the radially outer housing contour 13 defined above can be used on a radial compressor in the region of the inlet flow channel 10, either alone or combined with one another, in order to improve the aero-thermodynamic characteristic of the same, in particular in order to ensure with a minimization of pressure loss in the region of the inlet flow channel 10 a greater uniformity of the inflow to the impeller 11 positioned downstream of the inlet flow channel 10, specifically with a simultaneous reduction of the axial length of the radial compressor.

All design parameters defined above, which can be employed either alone or in any combination with one another serve one and the same objective namely the improvement of the aero-thermodynamic characteristic of the radial compressor while simultaneously ensuring a compact axial design.

The inlet guide blades 14 positioned in the inlet flow channel 10 can be two-dimensionally or even three-dimensionally profiled guide blades. In the case of two-dimensionally profiled guide blades cross sections are of the same type or uniform perpendicularly to the stacking axis 26 in the direction of the stacking axis 26. In the case of three-dimensionally profiled inlet guide blades 14, these cross sections have different contours along the stacking axis 26, so that the inlet guide blades 40 have in particular curved flow inlet edges 24 and/or curved flow outlet edges 25.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A radial compressor for a compressor arrangement having the radial compressor and an axial compressor, the radial compressor comprising:

an impeller (11) having an axis of rotation (16), the impeller (11) having moving blades (15);

an inlet flow channel (10) bounded by a continuously curved radially inner hub contour (12) and a radially outer housing contour (13); and inlet guide blades (14) arranged in the inlet flow channel (10), wherein a medium to be compressed is supplied to the impeller (11) via the inlet flow channel (10), and wherein the inlet flow channel (10) runs diagonally to the axis of rotation (16) of the impeller (11).

2. A compressor arrangement comprising an axial compressor and the radial compressor according to claim 1.

3. The radial compressor according to claim 1, wherein the inlet guide blades (14) have a stacking axis (26) and the stacking axis (26) includes an angle (β) with respect to the axis of rotation (16) of the impeller between 38.25° and 51.75°.

4. The radial compressor according to claim 1, wherein the inlet guide blades (14) have a stacking axis (26) and the stacking axis (26) includes an angle (β) with respect to the axis of rotation (16) of the impeller between 42.75° and 47.25°.

5. A radial compressor for a compressor arrangement having the radial compressor and an axial compressor, the radial compressor comprising:

an impeller (11) having an axis of rotation (16), the impeller (11) having moving blades (15);

an inlet flow channel (10) bounded by a radially inner hub contour (12) and a radially outer housing contour (13); and inlet guide blades (14) arranged in the inlet flow channel (10), wherein a medium to be compressed is supplied to the impeller (11) via the inlet flow channel (10), wherein the inlet flow channel (10) runs diagonally to the axis of rotation (16) of the impeller (11), and wherein the radially inner hub contour (12) has a start (17) and an end (18) and is continuously curved between the start (17) and the end (18).

6. A radial compressor for a compressor arrangement having the radial compressor and an axial compressor, the radial compressor comprising:

an impeller (11) having an axis of rotation (16), the impeller (11) having moving blades (15);

an inlet flow channel (10) bounded by a radially inner hub contour (12) and a radially outer housing contour (13); and inlet guide blades (14) arranged in the inlet flow channel (10), wherein a medium to be compressed is supplied to the impeller (11) via the inlet flow channel (10), wherein the inlet flow channel (10) runs diagonally to the axis of rotation (16) of the impeller (11), and wherein the radially outer housing contour (13) has a start (19) and an end (20), and wherein the part of the radially outer housing contour (13) adjacent to the start (19) comprises a linearly running section (22) and the part of the radially outer housing contour (13) adjacent to the end (20) comprises a curved section (23).

7. The radial compressor according to claim 6, wherein the inlet guide blades (14) have flow inlet edges (24) and flow outlet edges (25), and wherein radially outer ends of the flow inlet edges (24) and radially outer ends of the flow outlet edges (25) each merge into the linearly running section (22) of the radially outer housing contour (13).

8. The radial compressor according to claim 6, wherein the linearly running section (22) of the radially outer housing contour (13) includes an angle (α) with respect to the axis of rotation (16) of the impeller (11) between 42.75° and 71.25°.

9. The radial compressor according to claim 6, wherein the following relationships apply on the radially outer housing contour (13):

$$0.285<s1/(s3+s4)<0.475,$$

$$0.555<s2/(s3+s4)<0.925,$$

$$2.52<s3/s4<4.20,$$

wherein s1 is the edge length of the radially outer housing contour between the start of the radially outer housing contour and the end of the flow inlet edges of the inlet guide blades merging into the same, wherein s2 is the edge length of the radially outer housing contour between the start of the radially outer housing contour and the end of the flow outlet edges of the inlet guide blades merging into the same, wherein s3 is the edge length of the linearly running section of the radially outer housing contour, wherein s4 is the edge length of the curved running section of the radially outer housing contour, and wherein s1/(s3+s4)<s2/(s3+s4).

10. The radial compressor according to claim 9, wherein in the region of the radially outer housing contour (13) the following relationships apply:

$$0.323<s1/(s3+s4)<0.437,$$

$$0.629<s2/(s3+s4)<0.851,$$

$$2.856<s3/s4<3.864.$$

11. The radial compressor according to claim 9, wherein in the region of the radially outer housing contour (13) the following relationships apply:

$$0.361<s1/(s3+s4)<0.399,$$

$$0.703<s2/(s3+s4)<0.777,$$

$$3.192<s3/s4<3.528.$$

12. The radial compressor according to claim 6, wherein the linearly running section (22) of the radially outer housing contour (13) includes an angle (α) with respect to the axis of rotation (16) of the impeller (11) between 48.45° and 65.55°.

13. The radial compressor according to claim 6, wherein the linearly running section (22) of the radially outer housing contour (13) includes an angle (α) with respect to the axis of rotation (16) of the impeller (11) between 54.15° and 59.85°.

14. A radial compressor for a compressor arrangement having the radial compressor and an axial compressor, the radial compressor comprising:

an impeller (11) having an axis of rotation (16), the impeller (11) having moving blades (15);

an inlet flow channel (10) bounded by a radially inner hub contour (12) and a radially outer housing contour (13); and inlet guide blades (14) arranged in the inlet flow channel (10), wherein a medium to be compressed is supplied to the impeller (11) via the inlet flow channel (10), wherein the inlet flow channel (10) runs diagonally to the axis of rotation (16) of the impeller (11), and wherein the inlet guide blades (14) have a stacking axis (26) and the stacking axis (26) includes an angle (β) with respect to the axis of rotation (16) of the impeller between 33.75° and 56.25°.

15. A radial compressor for a compressor arrangement having the radial compressor and an axial compressor, the radial compressor comprising:

an impeller (11) having an axis of rotation (16), the impeller (11) having moving blades (15);

an inlet flow channel (10) bounded by a radially inner hub contour (12) and a radially outer housing contour (13); and inlet guide blades (14) arranged in the inlet flow channel (10), wherein a medium to be compressed is supplied to the impeller (11) via the inlet flow channel (10), wherein the inlet flow channel (10) runs diagonally to the axis of rotation (16) of the impeller (11), wherein the following relationships apply on the radially inner hub contour (12):

$$0.383<h1/h3<0.638,$$

$$0.518<h2/h3<0.863,$$

wherein h1 is the arc length of the radially inner hub contour between the start of the radially inner hub contour and the end of the flow inlet edges of the inlet guide blades merging into the same, wherein h2 is the arc length of the radially inner hub contour between the start of the radially inner hub contour and the end of the flow outlet edges of the inlet guide blades merging into the same, wherein h3 is the arc length of the radially inner hub contour between the start of the radially inner hub contour and the end of the radially inner hub contour, wherein h1/h3<h2/h3.

16. The radial compressor according to claim 15, wherein the following applies:

$$0.434<h1/h3<0.587,$$

$$0.587<h2/h3<0.794.$$

17. The radial compressor according to claim 15, wherein the following applies:

$$0.485<h1/h3<0.536,$$

$$0.656<h2/h3<0.725.$$

* * * * *